United States Patent [19]

Hartford

[11] Patent Number: 4,654,002

[45] Date of Patent: Mar. 31, 1987

[54] DUAL VALVE LIGHTING DEVICE

[76] Inventor: Glen Hartford, P.O. Box 246, Beverly Hills, Calif. 90213

[21] Appl. No.: 863,724

[22] Filed: May 16, 1986

[51] Int. Cl.[4] ..... F23Q 1/04

[52] U.S. Cl. ..... 431/254; 431/344

[58] Field of Search ..... 431/130, 131, 142, 143, 431/150, 254, 255, 273, 274, 277, 344

[56] References Cited

U.S. PATENT DOCUMENTS

| | | | |
|---|---|---|---|
| 3,922,139 | 11/1975 | Sugawa | 431/344 |
| 4,153,233 | 5/1979 | Neyret | 431/344 X |
| 4,207,032 | 6/1980 | Collaud et al. | 431/150 |
| 4,243,377 | 1/1981 | Schmid | 431/344 |

FOREIGN PATENT DOCUMENTS

| | | | |
|---|---|---|---|
| 1202785 | 8/1970 | United Kingdom | 431/142 |

*Primary Examiner*—Margaret A. Focarino

*Attorney, Agent, or Firm*—Cislo & Thomas

[57] ABSTRACT

A lighter is provided having the capability of providing one of two flames, one flame of the more conventional 1½ to 2 inches in length for lighting a cigarette, cigar, pipe or the like, and the other flame of a less conventional 12 to 16 inches in length for reaching places otherwise difficult to reach, such as fireplaces. The lighter employs two valves, which may be adjustable, each separately connected with the fuel reservoir and provided with an actuating plunger. The two valve plungers are actuated by a grip handle which in one position depresses one of the plungers and in another position depresses the second plunger. In such manner, the two flames of different length are generated.

10 Claims, 3 Drawing Figures

DUAL VALVE LIGHTING DEVICE

BACKGROUND OF THE INVENTION

This invention relates to lighting devices more commonly known as lighters, and, more particularly, to a lighting device having two separate controlled flame outputs.

It is well-known that lighters which are charged with a liquified gas, such a butane, are normally operated by means of a button or lever which, when depressed, opens a valve to permit escape of the gas while a spark is simultaneously supplied to ignite the gas. The valve must include elements which perform two functions. The first function relates to opening and closing (called obturating); the second relates to throttling or metering of the gas. The latter function must be adjustable to enable the user to regulate the height of the flame with due regard for varying gas pressure.

Various approaches have been taken to improve such lighting devices. For example, U.S. Pat. No. 4,243,377 discloses separating the two functions, and provides a separate mechanism for each function.

U.S. Pat. No. 4,207,032 discloses a lighter with a reserve reservoir in addition to the main reservoir. The lighter is rechargable and includes a filling device that includes two serially disposed valves, one valve permitting transfer of the contents from the reserve reservoir to the main reservoir and the second valve permitting filling of both reservoirs.

Adjustment of flame height is taught in, for example, U.S. Pat. No. 3,922,139 and 4,153,233.

However, of the patents with which Applicant is aware, none teach a lighter having the capability of providing a flame suitable for lighting cigarettes and the like and also suitable for igniting hard to reach materials, such as in a fireplace. The latter function requires a flame on the order of 12 to 16 inches, which is not taught by such patents. Thus, there remains a need to provide such a lighting device.

OBJECTS AND SUMMARY OF THE INVENTION

Accordingly, it is an object of the present invention to provide a lighting device having the dual capability of emitting a first flame of a relatively short length and emitting a second flame of a relatively longer length.

It is another object of the present invention to provide a dual lighting device having a refill or rechargeable capability.

It is yet another object of the present invention to provide a dual lighting device having adjustable valves which separately adjust the length of the flames generated by actuation of each valve.

It is a still further object of the present invention to provide a dual lighting device that is hand held and easy to use in generating each flame.

These and further objects of the invention will become more readily apparent upon a consideration of the following commentary taken in conjuction with the drawings.

Briefly, a gas-fired lighting device for generating one of two flames, each of a different length, comprises a gas reservoir, two adjustable gas distribution valves separately connected to the gas reservoir, a nozzle connected to each of the gas distribution valves, a lighting assembly comprising a wheel and a spring-loaded flint, and a grip means for actuating the valves, the valves each actuated by a plunger of separate predetermined length such that depressing the grip means a first amount acutates only one valve and depressing the grip means a further second amount actuates another valve, thereby providing a flame of a length depending on the extent of depressing of the grip means.

The lighting device of the invention provides the capability of generating two flames of considerably different length. The first flame, suitable for lighting cigarettes, cigars, pipes and the like, is on the order of 1½ to 2 inches in length, while the second flame, suitable for reaching areas otherwise difficult to reach with a match or flame of the first length, is on the order of 12 to 16 inches.

DETAILED DESCRIPTION OF THE INVENTION

Figure 1:
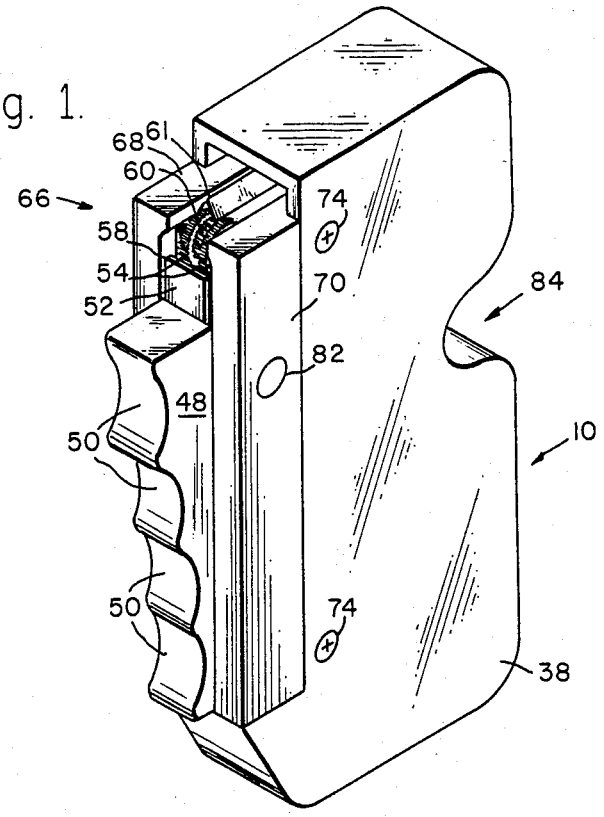
FIG. 1 is a perspective view of the lighting device of the invention.
Figure 2:
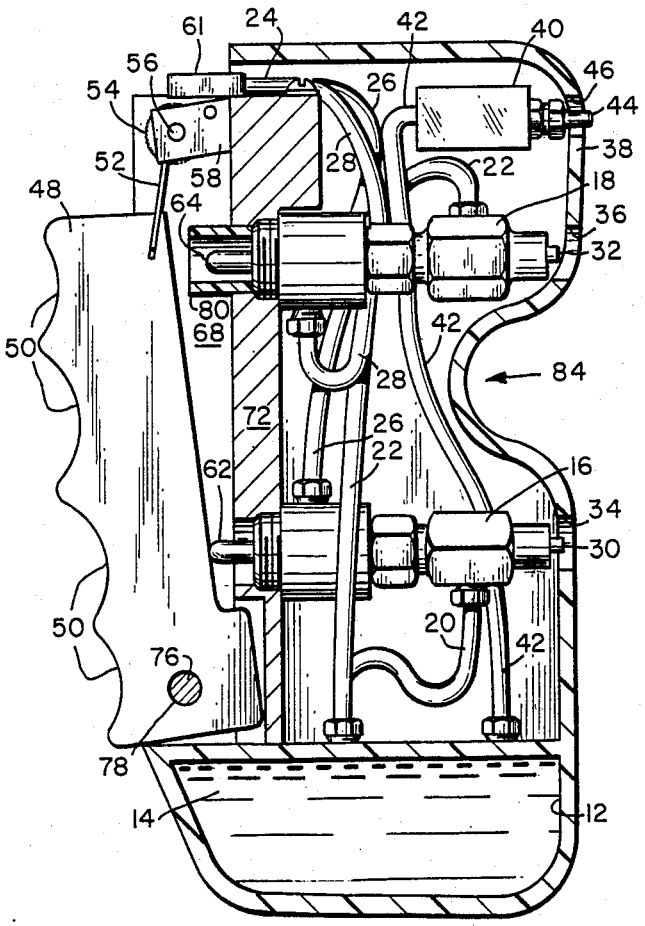
FIG. 2 is a left side elevational view of the lighting device of the invention, with the cover removed to expose the inside of the device.
Figure 3:
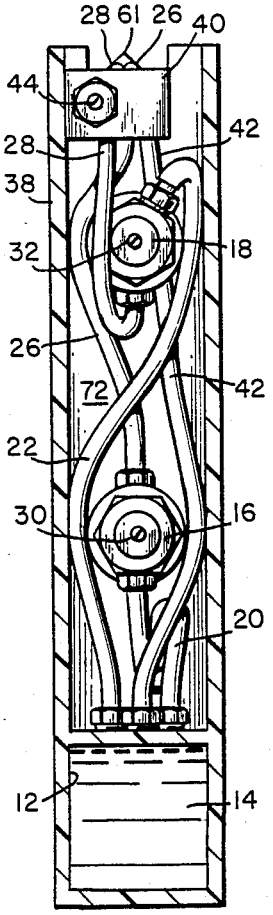
FIg. 3 is a rear elevational view of the device, partially cut-away, with the cover removed to expose the inside of the device.

Referring now to the drawing wherein like numerals designate like elements throughout, a lighting device is depicted generally at 10. The lighting device includes a reservoir 12, in which is contained a liquified gas 14, such as butane.

Two gas distribution valve members 16, 18 are provided, each separately connected to the reservoir 12 by flexible tubing members 20, 22, respectively. Each valve member 16, 18 is connected to a nozzle means 24 by flexible tubing members 26, 28 respectively. The valve members 16, 18 are thus connected in parallel configuration between the reservoir 12 and the nozzle 24.

The valves 16, 18 are spearately adjustable by means of adjusting screw means 30, 32, respectively, individually accessible through openings 34, 36, respectively, in body or casing 38.

An optional fill valve member 40, provided with an internal check valve, is connected to the reservoir 12 by flexible tubing member 42. A nozzle means 44, accessible through opening 46 in the casing 38, permits connection to a suitable fill mechanism (not shown) for refilling the reservoir 12 when empty.

A handle member 48, having concavities 50 to form a hand grip, is used to actuate the gas distribution valves 16, 18. The handle 48 has partially embedded therein a strike plate member 52, which is cooperatively associated with striking means, preferably comprising a pair of knurled wheel members 54, rotatably mounted on an axis 56 connected to a pair of side supports 58. Between the pair of wheels 54 is a striker 60 which is cooperatively associated with a length of flint (not shown), supported in place by a spring means (not shown), as is conventional. Movement of the striker 60 against the flint creates a spark for igniting the gas emanating from the nozzle 24. A hood member 61, attached to the top of the nozzle 24, extends outward therefrom and directs the flame away from the casing 38.

Cooperatively associated with the handle 48 are plungers 62, 64. Each plunger 62, 64 is operatively connected with gas distribution valve body 16, 18, respectively, to move a piston member internal to the valve, as is well-known for valves of this type.

Movement of at least one of the plungers 62, 64 inwardly, as by pressing handle 48 intoward the casing 38, causes at least one of the corresponding valves 16, 18 to open, thereby permitting gas from the reservoir 12 to be delivered to the nozzle 24. Since the movement of the handle 48 inwardly also causes the rotation of the striker 60 to generate a spark, the gas emanating from the nozzle 24 is ignited.

A support assembly 66 comprises side supports 68, 70, separated by a back support plate 72, which runs the length of the side supports 68, 70. The support assembly 66 is configured to partially extend into the interior of the casing 38, thereby forming a closure on one side thereof. The support assembly 66 is attached to the casing 38 by means such as screws 74, two of which are shown, the other two being on the obverse side of the casing 38.

The support assembly 66 provides support for the handle 48, the nozzle 24, the pair of wheels 54, the flint and the gas distribution valves 16, 18. In particular, the valve members 16, 18 are supported one above the other, in spaced apart relationship.

The handle 48 is maintained between side supports 68, 70. The handle 48 rotates on a pivot 76. Pivot 76 is conveniently a screw that is threadably screwed through one support, here 68, through an orifice 78 in the handle 48 and into a blind hole in the second support 70.

The back support plate 72 provides support for the valves 16, 18 and includes openings for the plungers 62, 64 to be engaged by the handle 48.

The second, or upper, plunger 64 is provided with a spring means 80 to ensure that the handle returns to its original position. A metal spring may be used or a length of resilient plastic tubing or other suitable spring means may be employed.

A stop 82 is provided to ensure that the strike plate 52 of the handle 48 does not get trapped behind the pair of wheels 54. Conveniently, the stop comprises an Allen screw, although other suitable means, such as a tang means formed as part of one of the side supports 68, 70, will also be adequate.

Slight movement of the handle 48 is sufficient to activate only the first plunger 62 to thereby cause valve 16 to open. This valve is adjusted by means of adjustment screw 30 to provide a flame suitable for lighting cigarettes, cigars, pipes and the like. The length of such a flame is on the order of 1½ to 2 inches.

Further movement of the handle 48 activates both plungers 62, 64 to thereby cause both valves 16, 18 to open. The valve 18 is adjusted by means of adjustment screw 32 to provide a flame suitable for lighting materials or objects in otherwise hard to reach places. The length of the flame in this instance is on the order of 12 to 16 inches. Examples of suitable uses include starting a fire in a fireplace, "zapping" a bug on the fly and the like.

For convenience, the casing 38 may be provided with a concavity 84, which accommodates the thumb of the user. Such concavity 84 permits a stronger grip to be exerted on the casing 38 and renders the handling of the lighting device 10 more facile.

The side support assembly is conveniently fabricated from metal, such as aluminum. The valves are also of metal and are of well-known construction. The flexible tubing used to interconnect the reservoir and valves and nozzle is a plastic, such as Tygon tubing. The material used in the casing is conveniently a durable plastic, such as poly(methyl methacrylate) or polycarbonate or the like, preferably at least partially transparent for both aesthetic effect and to permit monitoring the level of the reservoir 12. Most preferably, a smoked plastic is employed.

Thus, a dual valve light device has been disclosed. Many changes and modifications will readily occur to those of skill in the art, and all such changes and modifications are within the scope of the invention, as defined by the appended claims.

What is claimed is:

1. A gas-fired lighting device for providing one of two flames, each of a different length comprising:

(a) a body having a gas reservoir for storing a liquified gas;

(b) two gas distribution valve members, each having an inlet and an outlet, each said inlet separately connected to said gas reservoir to permit the flow of gas therefrom when open, each valve member provided with a plunger means for opening and closing said valve member;

(c) a nozzle member connected to said outlets of said valve members;

(d) a lighting assembly comprising a flint and a striking means cooperatively associated with said flint for generating a spark;

(e) means for supporting said valve members, nozzle member and lighting assembly in cooperative association; and (f) a grip means for actuating at least one of said plunger means and simultaneously generating a spark, said grip means operatively contacting said plunger means and further provided with means for activating said striking means to thereby generate said spark substantially simultaneously upon causing at least one of said valve members to open, said grip means supported by support means in a configuration such that depressing said grip means a first amount acutates only a first gas distribution valve member and depressing said grip means a further second amount acutates a secong gas distribution valve member, thereby providing a flame of a given length depending upon the extent of depressing of said grip means.

2. The lighting device in accordance with claim 1 further including valve means accessible through said body for refilling said gas reservoir.

3. The lighting device in accordance with claim 1 wherein said gas distribution valve members are each provided with separate adjusting means.

4. The lighting device in accordance with claim 1 wherein said grip means comprises a downwardly depending member of a length to be associated with the hand of a user and is rotatably mounted between side supports of said support means, said rotation being about an axis through the lower part of said grip means.

5. The lighting device in accordance with claim 4 wherein said valves are positioned such that a slight depressing movement inward of said grip means moves a first plunger sufficient to open said first gas distribution valve member and further movement inward moves a second plunger sufficient to open said second gas distribution valve member.

6. The lighting device in accordance with claim 5 wherein said first gas distribution valve member permits generating a flame of a length of about 1½ to 2 inches and said second gas distribution valve member permits generating a flame of a length of about 12 to 16 inches.

7. A gas-fired lighting device for providing one of two flames, each of a different length comprising:

(a) a body having a gas reservoir for storing a liquified gas;

(b) first and second adjustable gas distribution valve members, each having an inlet and an outlet and provided with first and second plunger means, respectively, for opening and closing said first and second valve members, respectively;

(c) a nozzle member;

(d) means for inteconnecting said nozzle member with said reservoir through said first and second valve members, said valve members being disposed in parallel configuration between said nozzle member and said gas reservoir;

(e) a lighting assembly comprising a flint and a striking means cooperatively associated with said flint for striking a spark;

(f) support means vertically disposed for supporting said first and second gas distribution valve members in spaced apart relationship, with one valve situated above the other, said support means further supporting said nozzle member and said lighting assembly above said valves; and (g) a grip means for actuating at least one of said first and second plunger means and simultaneously generating a spark said grip means operatively contacting said plunger means and further provided with means for activating said striking means to thereby generate said spark substantially simultaneously upon causing at least one of said valve members to open, said grip means comprising a downwardly depending member of a length to be associated with the hand of a user and rotatably mounted between side supports of said support means, said rotation being about an axis through the lower part of said grip means, with said valves positioned such that slight movement inward to said casing moves said first plunger sufficient to open said first gas distribution valve member and further movement inward moves said second plunger sufficient to open said second gas distribution valve member, thereby providing a flame of a length depending upon the extent of depressing of said grip means.

8. The lighting device in accordance with claim 7 further including valve means accessible through said body for refilling said gas reservoir.

9. The lighting device in accordance with claim 7 wherein said first gas distribution valve member generates a flame of a length of about 1½ to 2 inches and said second gas distribution valve member generates a flame of a length of about 12 to 16 inches.

10. The lighting device in accordance with claim 7 wherein said second gas distribution valve member, together with said second plunger means, is situated above said first gas distribution valve member, together with said first plunger means, and a resilient spring means is cooperatively associated with said second plunger means and said grip means to return said grip means to its original position.

* * * * *